US005106326A

United States Patent [19]

Tsuji et al.

[11] Patent Number: 5,106,326

[45] Date of Patent: Apr. 21, 1992

[54] CONNECTOR HOUSING AND HINGE-CONNECTED LID THEREFOR

[75] Inventors: Masanori Tsuji; Takayuki Yamamoto, both of Shizuoka, Japan

[73] Assignee: Yazaki Corporation, Tokyo, Japan

[21] Appl. No.: 664,892

[22] Filed: Mar. 5, 1991

[30] Foreign Application Priority Data

Mar. 20, 1990 [JP] Japan ..... 2-27688[U]

[51] Int. Cl.[5] ..... H01R 13/40

[52] U.S. Cl. ..... 439/596; 220/375

[58] Field of Search ..... 439/372, 595, 596, 695, 439/701, 467, 718; 220/337, 339, 375

[56] References Cited

U.S. PATENT DOCUMENTS

| | | | |
|---|---|---|---|
| 2,958,439 | 11/1960 | Yochem | 220/375 X |
| 3,332,053 | 7/1967 | Busler | 439/596 |
| 3,945,594 | 3/1976 | Burt | 439/467 X |
| 4,070,078 | 1/1978 | Chrones . | |
| 4,228,317 | 10/1980 | Cziment . | |
| 4,250,349 | 2/1981 | Bennett . | |
| 4,660,914 | 4/1987 | Nakamura | 439/596 |
| 4,767,361 | 8/1988 | Hoshino et al. | 439/596 |
| 4,898,550 | 2/1990 | Ayer | 439/718 |

FOREIGN PATENT DOCUMENTS

| | | | |
|---|---|---|---|
| 2913038 | 10/1980 | Fed. Rep. of Germany | 439/718 |

*Primary Examiner*—Neil Abrams
*Assistant Examiner*—Khiem Nguyen
*Attorney, Agent, or Firm*—Sughrue, Mion, Zinn, Macpeak & Seas

[57] ABSTRACT

A connector housing and a lid are formed integrally of synthetic resin, the lid being connected in hinged fashion to the connector such that the lid travels in a substantially constant orbit so that engagement portions thereof lock with corresponding lock levers on the connector housing. The overall construction facilitates closing and opening with one-hand operation.

6 Claims, 2 Drawing Sheets

CONNECTOR HOUSING AND HINGE-CONNECTED LID THEREFOR

BACKGROUND OF THE INVENTION

This invention relates to a connector housing, and to a lid connected through an integral hinge to a relatively small housing made of a synthetic resin, as for example a connector housing used in an electric wiring of an automobile.

As shown in FIGS. 3 and 4, a terminal retainer lid c is formed integrally with a connector housing a of a synthetic resin through a flexible hinge strip b. A flexible retaining piece e is provided within a terminal receiving chamber d of the connector housing a, and a retaining hole f is formed in the rear end of the connector housing. A retaining projection g for the retaining hole f and an engaging portion h for the rear end of the connector housing a are provided on the terminal retainer lid c.

In the foregoing construction, when the connector is to be used, a metal terminal j, previously connected to an electric wire i, is inserted into the terminal receiving chamber d from the rear end of the connector housing a, and is retained by the flexible retaining piece e, thus achieving primary retention. Then, the terminal retainer lid c is closed, and the retaining projection g is engaged in the retaining hole f while engaging the engaging portion h with the rear end of the connector housing a, thereby fixing the lid to the connector housing. As a result, the terminal retainer lid is engaged with the rear end portion of the metal terminal j, thereby effecting secondary retention of the metal terminal.

When the lid is to be closed, the fulcrum of pivotal movement thereof is not constant, because the terminal retainer lid c is connected to the connector housing through the relatively long, flexible hinge strip b. As a result, both hands are needed to engage the retaining projection g in the retaining hole f. Thus, this construction is disadvantageous in that the lid closing operation is cumbersome.

SUMMARY OF THE INVENTION

In view of the above problem, it is an object of this invention to provide a construction in which a lid, connected to a housing by a flexible hinge strip, can be closed easily and rapidly with one hand.

The above object has been achieved by a hingedly connected lid in a housing made of a synthetic resin, the housing and the lid being formed integrally of a synthetic resin and connected together by a flexible hinge strip In the invention, an abutment plate portion is formed on a hinge connecting side of the lid. A support wall portion and a lid closure-fulcrum wall portion are formed on a hinge connecting side of the housing. The lid is closed by urging the abutment plate portion against the lid closure-fulcrum wall portion, so that the free end of the lid is moved along a substantially constant orbit and is engaged with a lock member on the housing.

DETAILED DESCRIPTION OF THE PREFERRED EMBODIMENT

Figure 1:
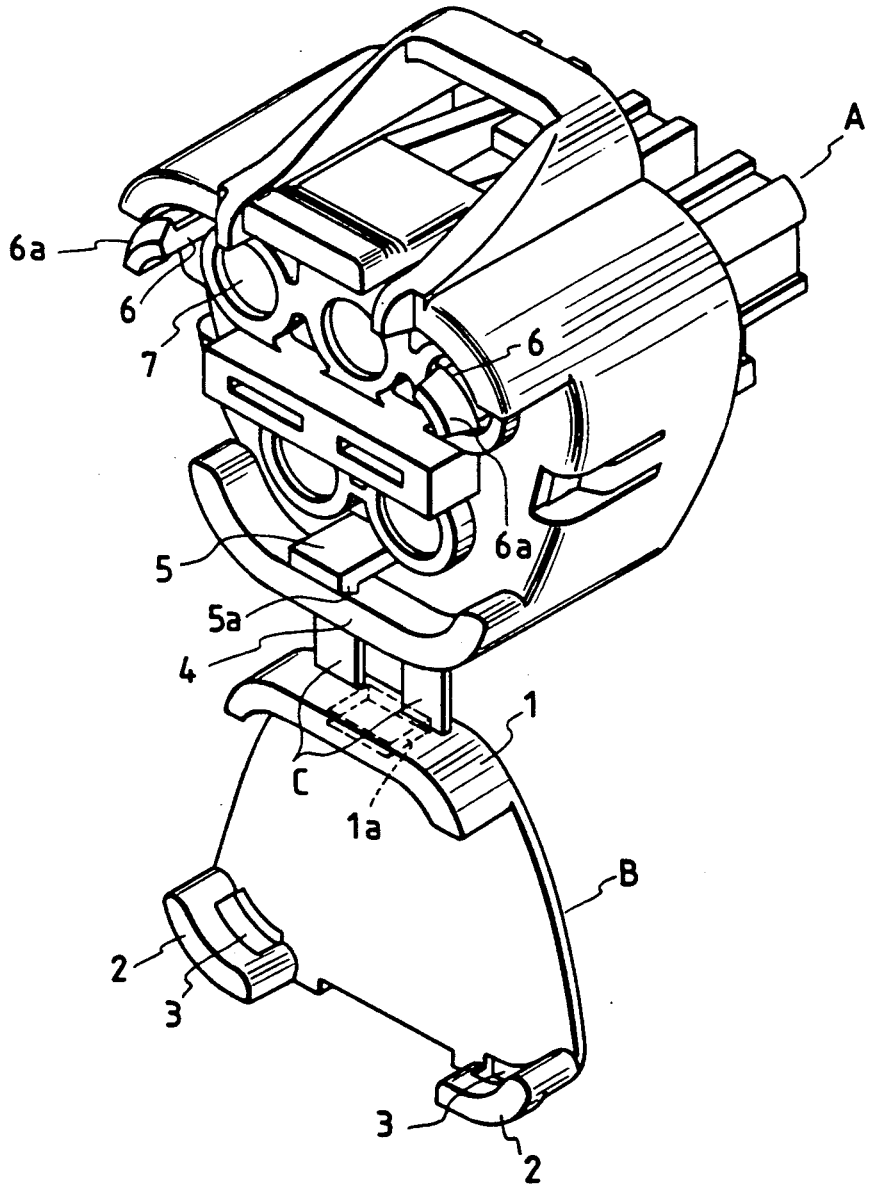
FIG. 1 is a perspective view of a preferred embodiment of the present invention in a lid-closed condition.
Figure 2:
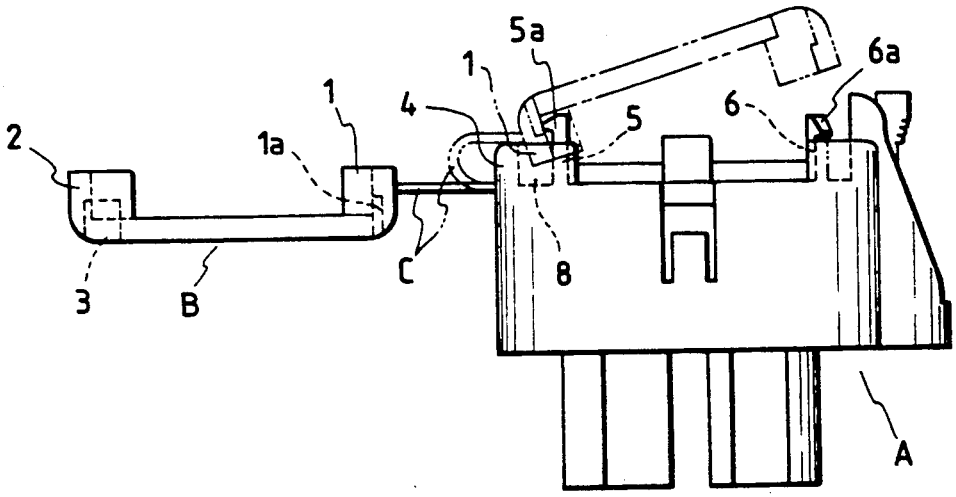
FIG. 2 is a side-elevational view of the above embodiment, showing the lid-closing operation.
Figure 3:
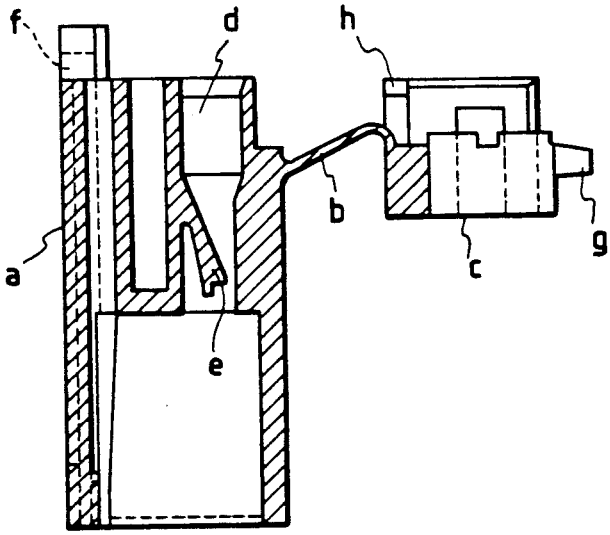
FIG. 3 is a cross-sectional view of a conventional structure in a lid-opened condition.
Figure 4:
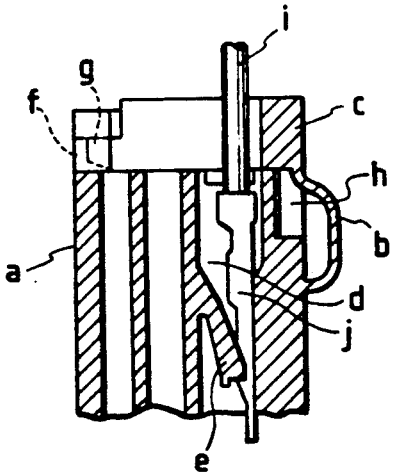
FIG. 4 is a cross-sectional view of the conventional structure in a lid-closed condition.

Referring to FIG. 1, a synthetic resin lid B is formed integrally with a synthetic resin connector housing A through a pair of flexible hinge strips C.

An abutment plate portion 1 is formed on the proximal end portion of the lid B close to the hinge-connecting side Engagement guide plate portions 2, as well as retaining holes 3, are provided at the free end portion of the lid B.

A short support wall portion 4 and a lid closure-fulcrum wall portion 5 that is taller than the support wall portion 4 are provided at that portion of the rear end of the connector housing A close to the hinge connecting side thereof, the support wall portion 4 being disposed outwardly of the lid closure-fulcrum wall portion 5. These portions 4 and 5 cooperate with the abutment plate portion 1. A groove 8, in which the abutment plate portion 1 is adapted to be fitted, is formed between the support wall portion 4 and the lid closure-fulcrum wall portion 5. An outwardly directed hook-shaped retaining projection 5*a* is formed on the distal end of the lid closure-fulcrum wall portion 5. A retaining recess la for the hook-shaped retaining projection 5*a* is formed in the inner surface of the abutment plate portion 1.

Lock levers 6, each having an outwardly directed hook-shaped projection 6*a*, are formed on and projected from that portion of the rear end of the connector housing A remote from the hinge connecting side thereof In the above construction, when the lid is to be closed, the outer periphery of the connector housing A is gripped mainly by the index finger and the middle finger, and the hinge connecting side of the lid B is pushed by the thumb so as to abut the inner side of the abutment plate portion 1 against the distal end (i.e., the hook-shaped retaining projection 5*a*) of the lid closure-fulcrum wall portion 5. Further, the lid B is pushed by the thumb while moving the thumb over the lid B toward its free end. As a result, the engagement guide plate portions 2 are moved angularly along their respective predetermined orbits, and are abutted respectively against the hook-shaped projections 6*a* of the lock levers 6. These portions 2 slide respectively over the upper surfaces of the hook-shaped projections 6*a* so as to be moved angularly toward the outer sides thereof, so that the hook-shaped projections 6*a* are engaged in the retaining holes 3, respectively, thereby locking the lid closing condition. At this time, the abutment plate portion 1 is fitted in the groove 8, and the hook-shaped retaining projection 5*a* is engaged in the retaining recess 1*a*.

A metal terminal, previously connected to an electric wire, is inserted into a terminal receiving chamber 7, and is retained relative thereto. The electric wire is led out to the side of the connector housing through a gap between the connector housing A and the lid B.

As described above, according to the present invention, the housing and the lid are formed integrally of a synthetic resin and are connected together by a flexible hinge strip. An abutment plate portion is formed on the hinge connecting side of the lid, and the support wall portion and the lid closure-fulcrum wall portion are formed on the hinge connecting side of the housing. The lid is closed by urging the abutment plate portion against the lid closure-fulcrum wall portion, so that the free end of the lid is moved along a substantially constant orbit and is engaged with the lock member on the housing. With this construction, the lid can be closed and locked easily and rapidly with one hand.

While the invention has been described in detail above with reference to a preferred embodiment, various modifications within the scope and spirit of the invention will be apparent to people of working skill in this technological field Thus, the invention should be considered as limited only by the scope of the appended claims.

What is claimed is:

1. In a connector housing having a lid connected in a hinged fashion thereto, said housing and said lid being formed integrally of synthetic resin, the improvement wherein:

said lid includes an abutment plate portion on a hinge connecting side;

said housing includes a support wall portion and a lid closure-fulcrum wall portion on a hinge connecting side thereof, said support wall portion being discrete from said lid closure-fulcrum wall portion, and further including a lock member;

wherein when said lid is in an open position, said abutment plate portion is displaced from said housing and wherein said lid is closed by urging said abutment plate portion against said lid closure-fulcrum wall portion, so that a free end of said lid rotates about said closure-fulcrum wall portion along a substantially constant orbit and is engaged with said lock member.

2. A connector housing as claimed in claim 1, wherein said lock member comprises lock levers each having a hook-shaped projection, and said lid further includes engagement guide plate portions provided at said free end of said lid for engagement with a respective one of said lock levers.

3. A connector housing as claimed in claim 1, wherein said abutment plate portion is supported on said support wall portion when said lid is in a closed position.

4. A connector housing as claimed in claim 1, wherein said abutment plate portion includes means for engaging said closure-fulcrum wall portion so as to lock one side of said lid to said housing.

5. A connector housing as claimed in claim 1, wherein said closure-fulcrum wall portion projects outwardly from said housing further than said support wall portion such that said closure-fulcrum wall portion can be contacted by said abutment plate portion.

6. A connector housing as claimed in claim 1, wherein said closure-fulcrum wall portion is disposed internal to said support wall portion.

* * * * *